US008051955B2

(12) United States Patent
Therriault

(10) Patent No.: US 8,051,955 B2
(45) Date of Patent: Nov. 8, 2011

(54) ELEVATOR ALERT FOR FLUID OVERFLOW INTO ELEVATOR PIT

(76) Inventor: Ronald Therriault, Yulee, FL (US)

( * ) Notice: Subject to any disclaimer, the term of this patent is extended or adjusted under 35 U.S.C. 154(b) by 0 days.

(21) Appl. No.: 13/002,489

(22) PCT Filed: Nov. 13, 2008

(86) PCT No.: PCT/US2008/012721

§ 371 (c)(1),
(2), (4) Date: Jan. 3, 2011

(87) PCT Pub. No.: WO2010/011214

PCT Pub. Date: Jan. 28, 2010

(65) Prior Publication Data

US 2011/0108370 A1 May 12, 2011

(51) Int. Cl.
*B66B 1/34* (2006.01)

(52) U.S. Cl. ..... 187/391; 187/247

(58) Field of Classification Search ..... 187/247, 187/391–393

See application file for complete search history.

(56) References Cited

U.S. PATENT DOCUMENTS

| | | | | |
|---|---|---|---|---|
| 3,437,012 | A | 4/1969 | Bjorklund | |
| 3,857,359 | A | 12/1974 | Ward et al. | |
| 4,463,663 | A | 8/1984 | Hanson, Jr. et al. | |
| 4,680,575 | A | 7/1987 | Yazaki | |
| 4,735,291 | A | 4/1988 | Kappenhagen | |
| 5,065,139 | A | 11/1991 | Shefsky | |
| 5,078,236 | A | 1/1992 | Shimoaki | |
| 5,673,025 | A * | 9/1997 | Refugio et al. | 340/605 |
| 5,703,569 | A * | 12/1997 | Oliver et al. | 340/605 |
| 5,948,274 | A | 9/1999 | Lyon et al. | |
| 5,951,022 | A | 9/1999 | Gorman et al. | |
| 6,203,281 | B1 | 3/2001 | Gurega | |
| 6,273,021 | B1 | 8/2001 | Pembroke | |
| 6,321,876 | B1 * | 11/2001 | Kawai et al. | 187/391 |
| 6,374,723 | B1 | 4/2002 | Cook et al. | |
| 7,004,062 | B2 | 2/2006 | Paduano | |
| 7,131,330 | B2 | 11/2006 | Gurega | |
| 7,264,090 | B2 * | 9/2007 | Vecchiotti et al. | 187/391 |
| 2005/0235822 | A1 | 10/2005 | Paduano | |
| 2006/0139177 | A1 | 6/2006 | Gomery | |
| 2009/0255761 | A1 * | 10/2009 | Kawai | 187/247 |

FOREIGN PATENT DOCUMENTS

| | | | |
|---|---|---|---|
| JP | 06171857 | A * | 6/1994 |
| JP | 7-165380 | | 6/1995 |
| JP | 9-077421 | | 3/1997 |
| JP | 11-171435 | | 6/1999 |

* cited by examiner

*Primary Examiner* — Anthony Salata
(74) *Attorney, Agent, or Firm* — Richard C. Litman

(57) ABSTRACT

The elevator alert includes an elevator pit can (10) and a float switch (240) disposed therein. The float switch (240) produces an alarm-activating signal when the pit can (10) is nearly full and overflow of oil into the pit is imminent. An alarm control unit (200) takes alarm-activating signals from one or more float switch-equipped pit cans (10) to operate a relay (405*a*, 405*b*) to drive various kinds of alarms and/or elevator controls. A loudspeaker (210) on the pit can (10) emits an audible alarm when the float switch (240) is closed. Optionally, a remote alarm (300) is provided, the remote alarm (300) being activated when the remote alarm float switch (250) is closed. Users of the elevator, such as passenger or building occupants, would hear the audible alarm and call maintenance to thereby prevent an oil spill. The device can be retrofit to existing elevator pit cans.

15 Claims, 7 Drawing Sheets

ELEVATOR ALERT FOR FLUID OVERFLOW INTO ELEVATOR PIT

BACKGROUND OF THE INVENTION

1. Technical Field

The present invention relates to maintenance and safety devices for hydraulic elevators, and particularly to an elevator alert that emits an audible alarm when too much hydraulic fluid from leakage collects in an elevator pit.

2. Background Art

It is commonplace to utilize hydraulic cylinders for passenger or cargo raising and lowering within an elevator environment. The elevator car is raised and lowered by the below located hydraulic piston and cylinder assembly, which is typically located below grade or ground level in an elevator pit. Usually, with this type of elevator system, the hydraulic cylinder has a seal to retain the hydraulic fluid within it when the piston is raised and lowered. When the seal becomes faulty and leaks, unwanted amounts of hydraulic fluid escape the system. The fluid leakage is a potential environmental hazard if it flows into the environment.

Currently, the hydraulic fluid leakage is retained within a channeled annular ring just below the seal to catch the escaped fluid. The annular ring has a drainage hole to displace the collected, escaped fluid so that it does not flow over the ring. The drainage hole is connected to tubing or other conduit whose free end is typically placed in a large bucket to collect the fluid, which is gravity fed into the bucket. The bucket is simply placed on the ground of the elevator pit. Service technicians attend to the bucket from time to time to dispose of the displaced fluid in an environmentally appropriate manner.

However, this system of collecting displaced hydraulic fluid in an elevator pit has the drawback that the technician must remember to periodically check the bucket to ensure that the bucket contents do not overflow. If there is an abnormally large amount of escaping hydraulic fluid from the elevator mechanism, the bucket may overflow before the technician's scheduled maintenance check.

It would be desirable to have a signaling device to automatically warn elevator passengers and maintenance personnel when too much hydraulic fluid accumulates in the elevator pit.

Thus an elevator alert solving the aforementioned problems is desired.

DISCLOSURE OF INVENTION

The elevator alert includes an elevator pit can and a float switch disposed therein. The float switch produces an alarm-activating signal when the pit can is nearly full and overflow of oil into the pit is imminent. An alarm control unit takes a low voltage signal from one or more float switch-equipped pit cans to operate a relay that utilizes the signal to drive an alarm of various kinds and/or elevator controls. A loudspeaker is disposed on the pit can and emits an audible alarm when the float switch is closed. Optionally, a remote alarm is provided, the remote alarm being activated when the float switch is closed. The remote alarm may have a test switch for periodic maintenance, or the like. Users of the elevator, such as to passengers or building occupants, would hear the audible alarm and call maintenance to thereby prevent an oil spill.

The device may be marketed in the form of a kit to retrofit existing elevator pit cans for use with the elevator alert.

These and other features of the present invention will become readily apparent upon further review of the following specification and drawings.

BRIEF DESCRIPTION OF THE DRAWINGS

Similar reference characters denote corresponding features consistently throughout the attached drawings.

BEST MODES FOR CARRYING OUT THE INVENTION

Figure 1:
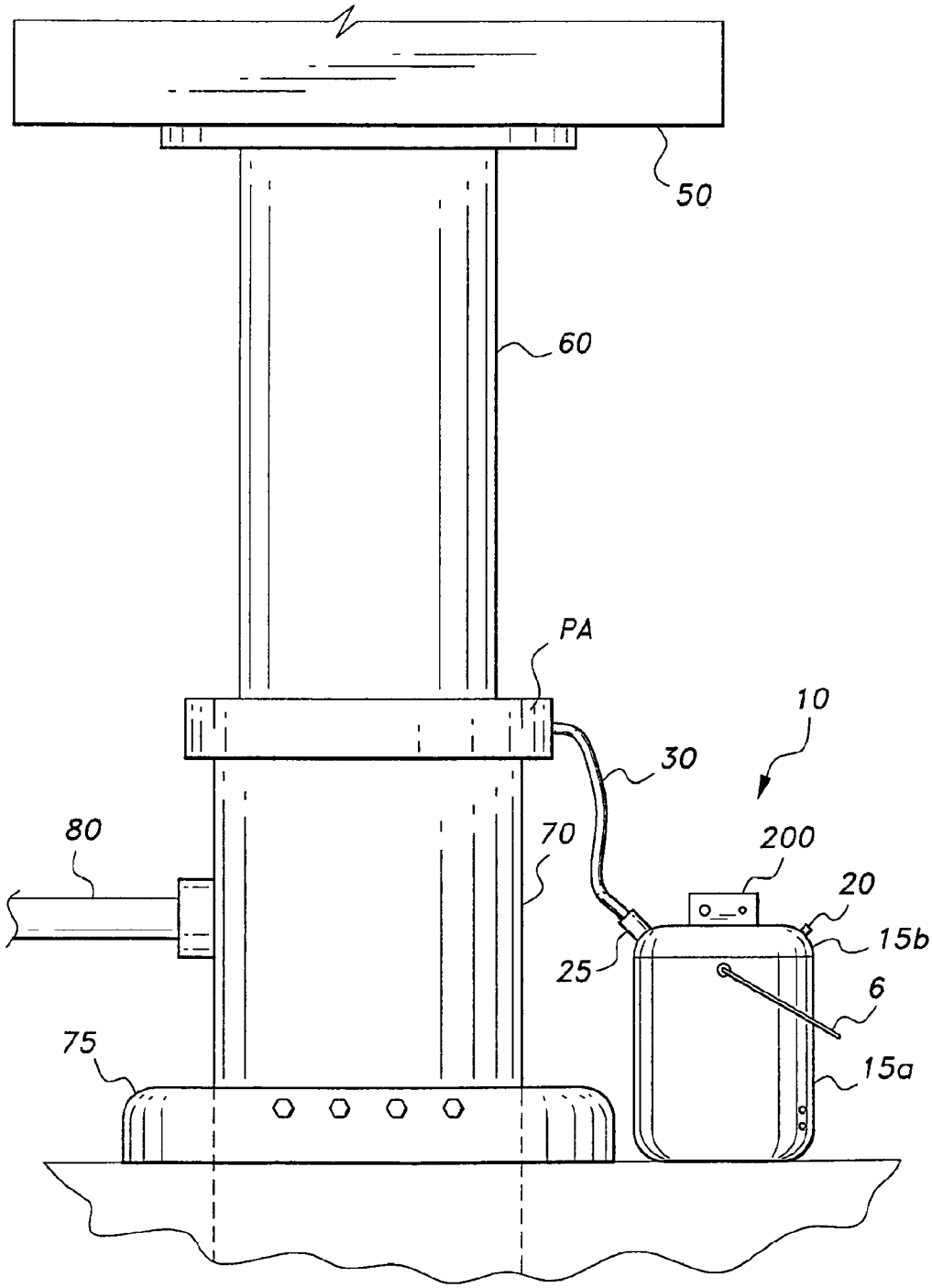
FIG. 1 is an environmental side view of an elevator alert according to the present invention.
Figure 2:
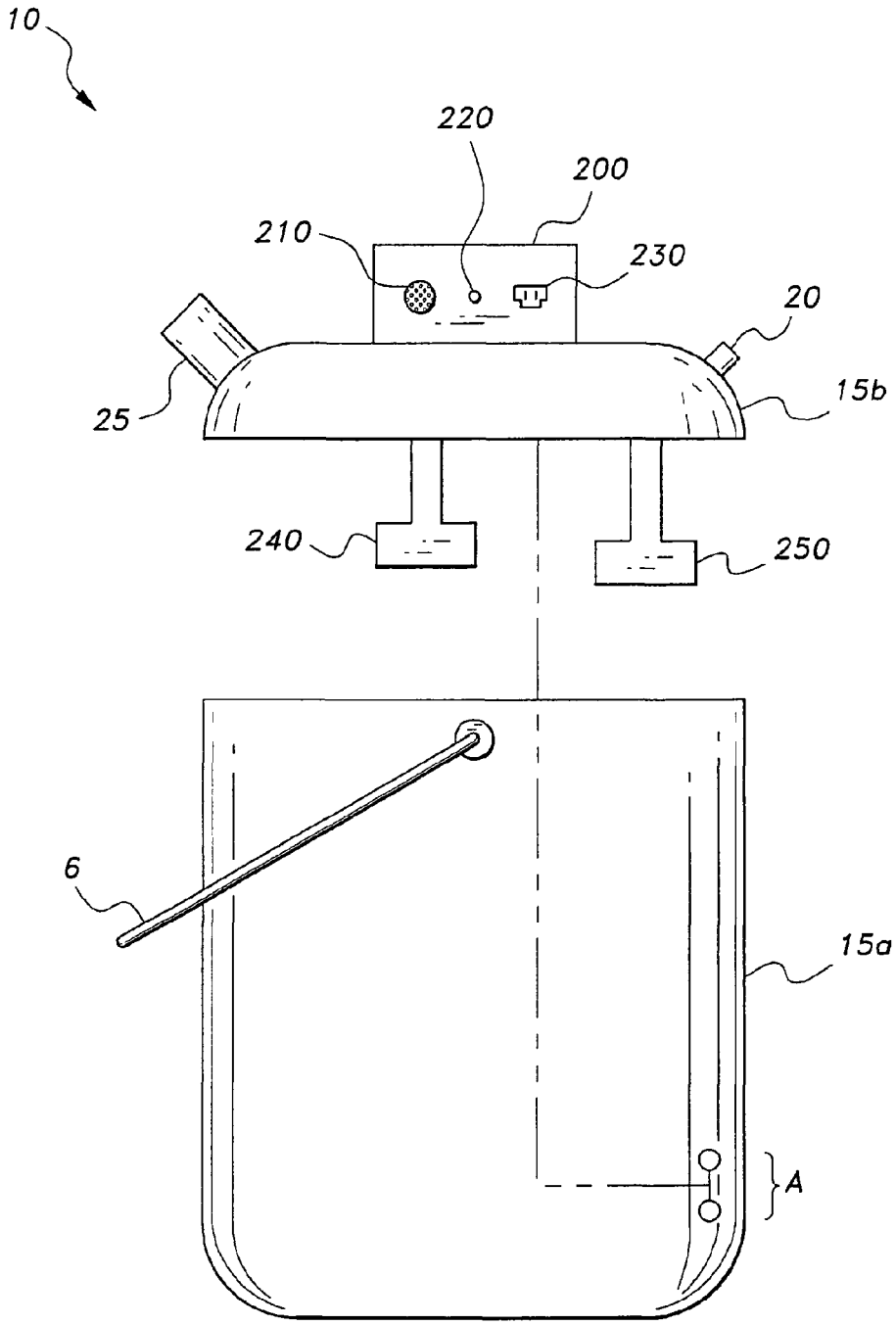
FIG. 2 is an exploded side view of the elevator alert according to the present invention.
Figure 3:
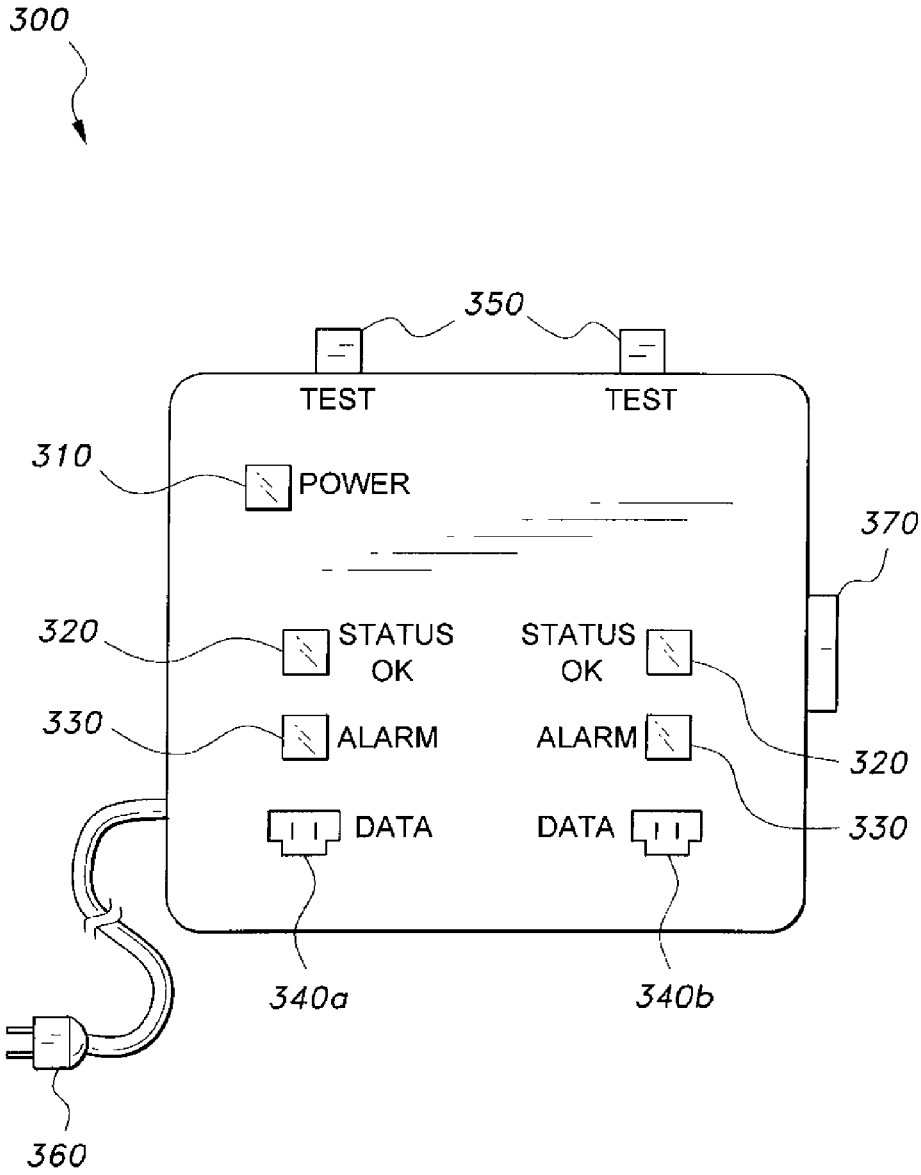
FIG. 3 is a plan view of an alert connector of the elevator alert according to the present invention.

As shown in FIGS. 1 and 2, the elevator alert is used with an elevator pit can 10 having at least one float switch disposed therein. The elevator car 50 is raised and lowered by a hydraulic piston 60 disposed inside a cylinder assembly 70, which is typically located below grade or ground level in an elevator pit. The cylinder 70 is often supported by a steel support 75 on the pit floor.

An oil line 80 feeds the cylinder 70 to supply hydraulic lift pressure to raise elevator 50 via piston 60. Oil seals are located inside an annular packing area PA, the annular packing area PA being disposed around the cylinder 70 and piston 60. It is not uncommon with this type of elevator system for the seal of packing area PA to retain the hydraulic fluid within it when the piston 60 is raised and lowered. When the seal becomes faulty and leaks, unwanted amounts of hydraulic fluid escape the system. The escaped fluid is a potential environmental hazard if it flows into the environment.

The packing area PA has a drainage outlet to displace the collected, escaped fluid so that it does not flow over the packing area PA. The drainage outlet of the packing area PA is connected to tubing 30 whose free end is connected to oil receiving spout 25 of pit can 10, which is positioned lower than the packing area PA, preferably on the pit floor.

The excess hydraulic fluid from packing area PA is gravity fed into pit can 10. The pit can 10 has a reservoir portion 15*a* to capture the gravity fed oil from the packing area PA. The reservoir portion 15*a* is capped off by a lid portion 15*b*. The lid portion 15*b* has an alarm mechanism 200 and a can breather 20. As most clearly shown in FIG. 2, float switches 240 and 250 are suspended from the can's lid portion 15*b*. Float switch 240 is operably connected to an on-board alarm 200. Float switch 250 can be operably connected to an external remote alarm/control unit 300.

Float switches 240 and 250 are preferably suspended at different heights within reservoir 15*a*. Thus, the float switches 240 and 250 are set to activate at different oil levels. Float switch 250 signals the external remote alert 300 before float switch 240 signals the alert 200 disposed on the can 10.

This arrangement allows an elevator company to be alerted before persons in the immediate vicinity of elevator 50 are alerted. Either of float switches 240 or 250 can produce an alarm-activating signal when the pit can 10 is nearly full and overflow of oil into the pit is imminent.

Moreover, the pit can 10 has a water sensor A disposed on an external bottom portion of reservoir 15*a*, the water sensor A detecting flooding conditions on the pit floor. During maintenance operations, the pit can 10 is easily transportable because it includes a handle 6. The alarm mechanism 200 includes a loudspeaker 210 capable of 85 dB or greater audible alert output when the alarm is activated.

A 3-pole test switch 220 is disposed on the alarm mechanism 200. Electronic circuitry within alarm mechanism 200 can detect a low voltage condition and alert a user with a chirping sound if a power source, e.g., a battery, is low. The 3-pole test switch 220 can switch the device 10 into an alarm test mode, a normal mode, and a silence mode. A low voltage data type quick to connect jack 230 is disposed on the mechanism 200, the data jack 230 being used to interconnect float switch 250 via a low voltage cable 470 to remote alarm 300.

The remote alarm 300 has a power light emitting diode (LED) 310, a STATUS/OK LED 320, an alarm LED 330, data connectors 340*a* and 340*b*, test switches 350, an ac mains power cord 360, and a wire knockout 370 (for wall mount/conduit installations). The remote alarm 300, responsive to switch status of float switch 250, can signal external devices, such as elevator controllers, fire system panels, modems, or the like. CAR 1 and CAR2 signal out jacks facilitate connectivity to the aforementioned external devices. Data connection jacks 340*a* and 340*b* facilitate connectivity to at least one pit can 10.

Figure 4:
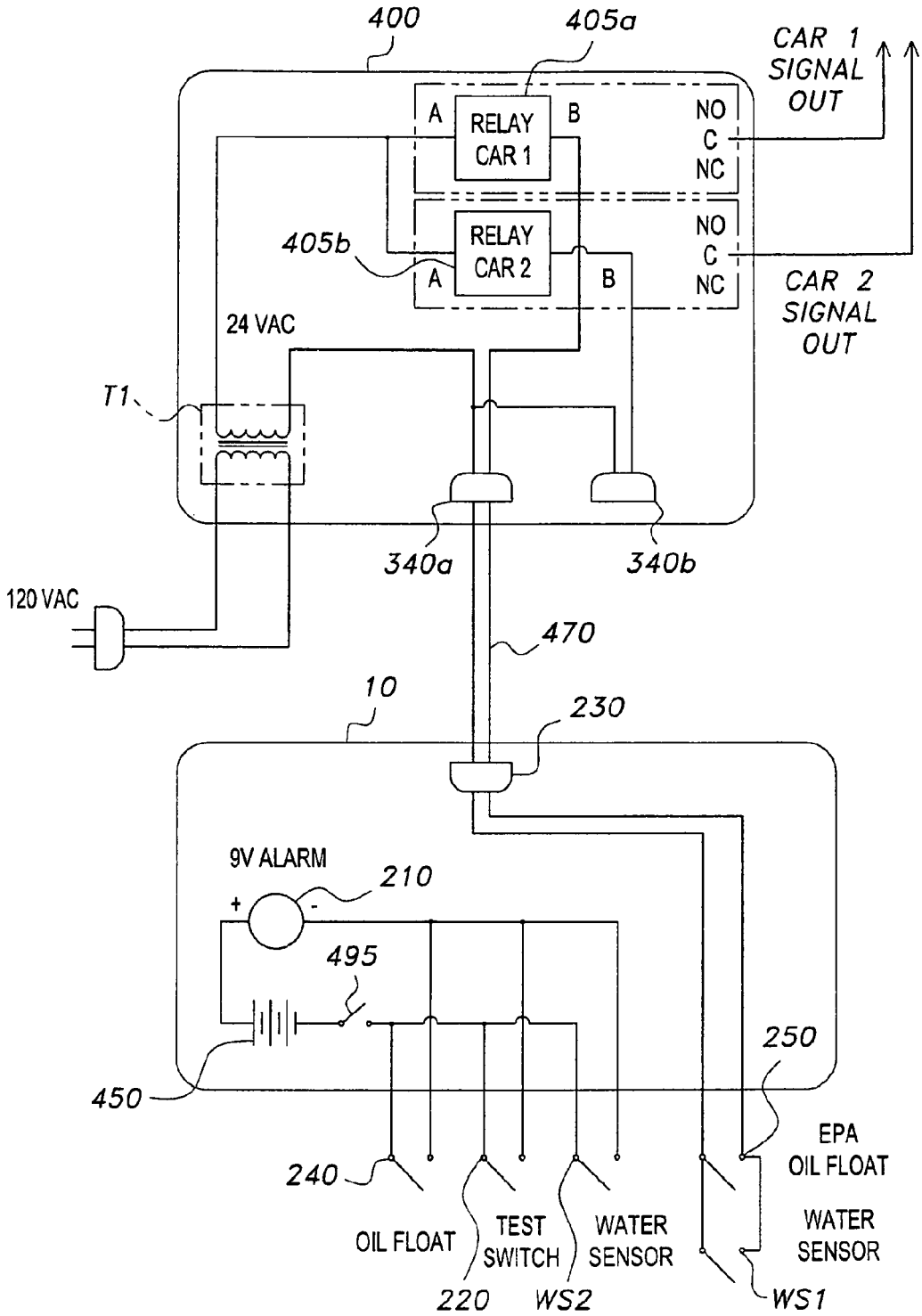
FIG. 4 is a schematic diagram of the elevator alert according to the present invention.

Alarm control circuitry 400 of remote alarm 300 includes a transformer T1 (as shown in FIG. 4) that transforms mains voltage to an appropriate voltage to power relays 405*a* and 405*b* which, in turn, deactivate the elevator cars (CAR1, CAR2) via CAR1 signal out and CAR2 signal out, respectively, when an alarm event occurs. Data connector 340*a* can accept signals from a pit can 10 via a data cable, such as data cable 470. A spare data connector 340*b* can accept signals from an additional pit can 10 (not shown). Switches WS1 and WS2 may be connected to at least one water sensor A (water sensor A is shown in FIG. 2), the switch status being sent to control circuitry 400 via interconnect cable 470 between can connector jack 230 and control connector jack 340*a*. The can 10 preferably has a self-contained battery power source 450 with an on/off switch 495.

Figure 5:
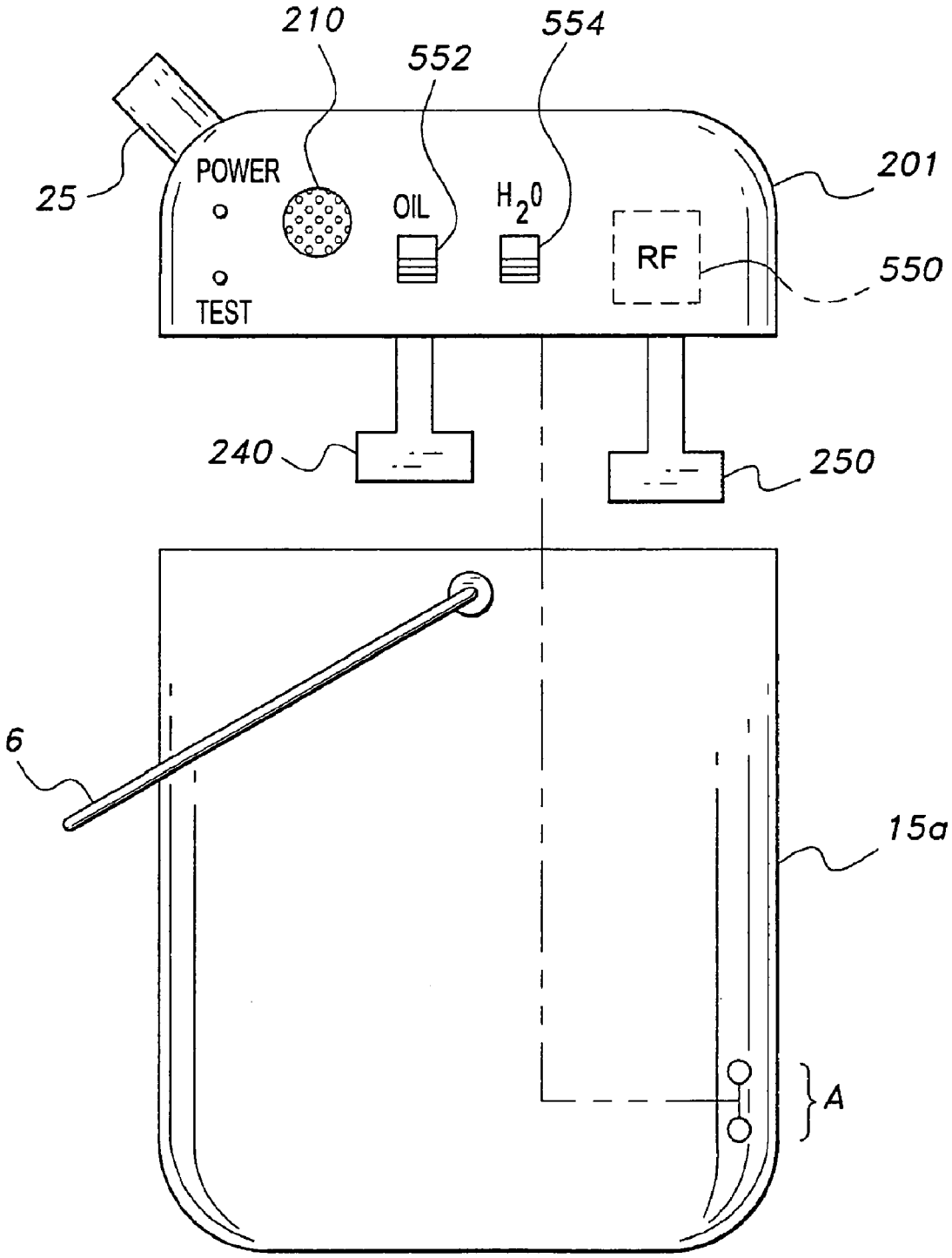
FIG. 5 is an exploded side view of an alternative embodiment of an elevator alert according to the present invention, capable of wireless operation.
Figure 6:
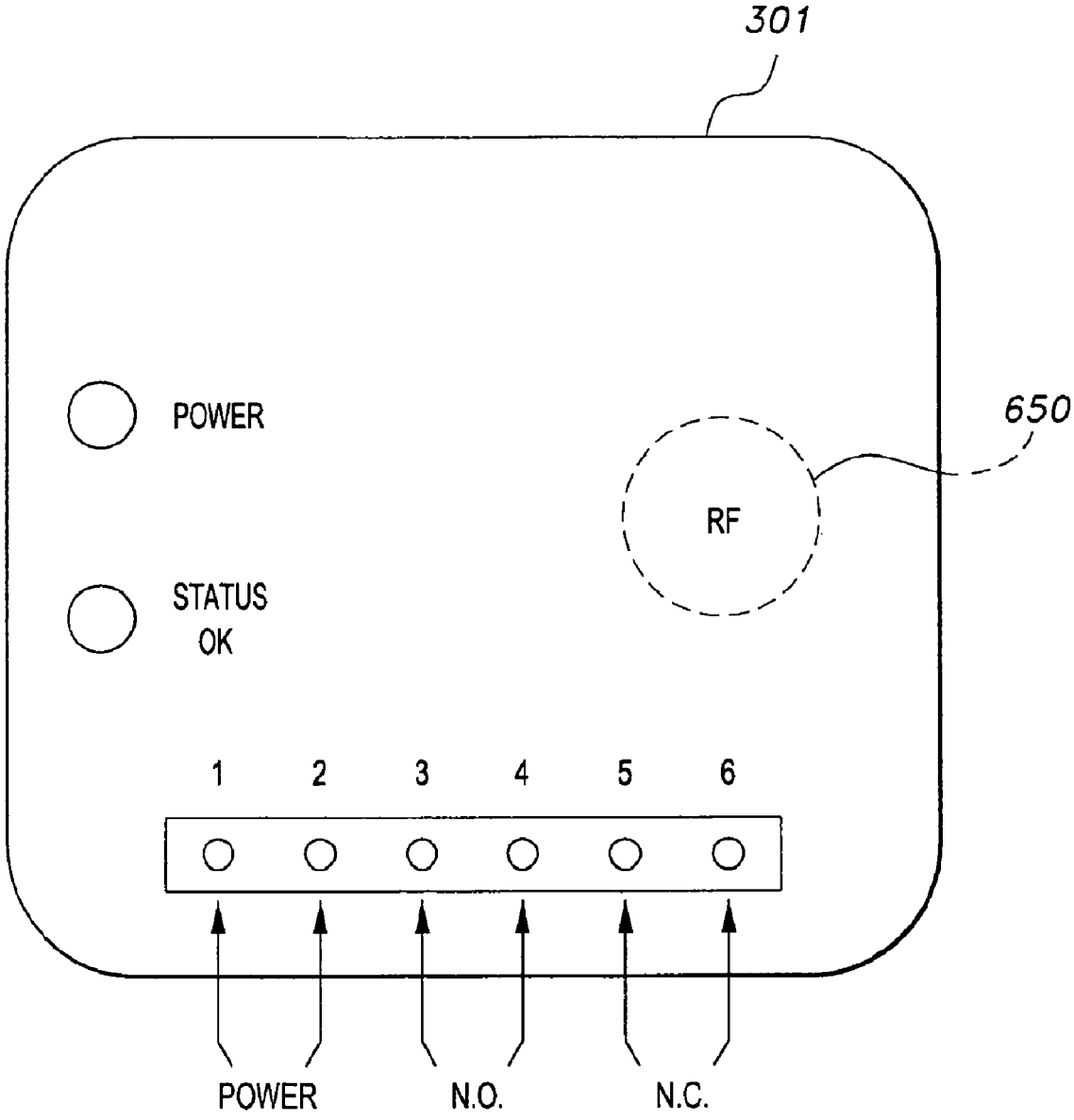
FIG. 6 is a plan view of an alert connector for the elevator alert of FIG. 5.

As shown in FIGS. 5 and 6, the pit can 10 may be equipped with a wireless device or transceiver 550 disposed in modified on-board alarm 201, the wireless transceiver 550 communicating with an external control unit 301, the control unit 301 having a corresponding wireless transceiver 650. Via wireless transceiver 550 of on-board alarm 201, a signal is transmitted to wireless transceiver 650 of control unit 301 when float 250 has tripped, so that the control unit 301 can respond to the alarm condition by internal electronic circuitry forwarding a service interrupt of the elevator equipment via normally open (NO) contacts 3, 4, 5, and 6. Power to the control unit 301 may be supplied at terminals 1 and 2. The on-board alarm 201 may also be equipped with an oil cutoff switch 552 and a water cutoff switch 554. The oil cutoff switch 552 has a silence position that shuts off an audible alarm from float 250. Similarly, the water cutoff switch 554 has a silence position that shuts off an audible alarm from water sensor A.

Preferably, the pit can 10 has approximately a 5-gallon capacity or more, and is formed from a translucent or semi-translucent material to facilitate easy visible inspection of fluid levels inside the pit can reservoir 15*a*.

Figure 7:
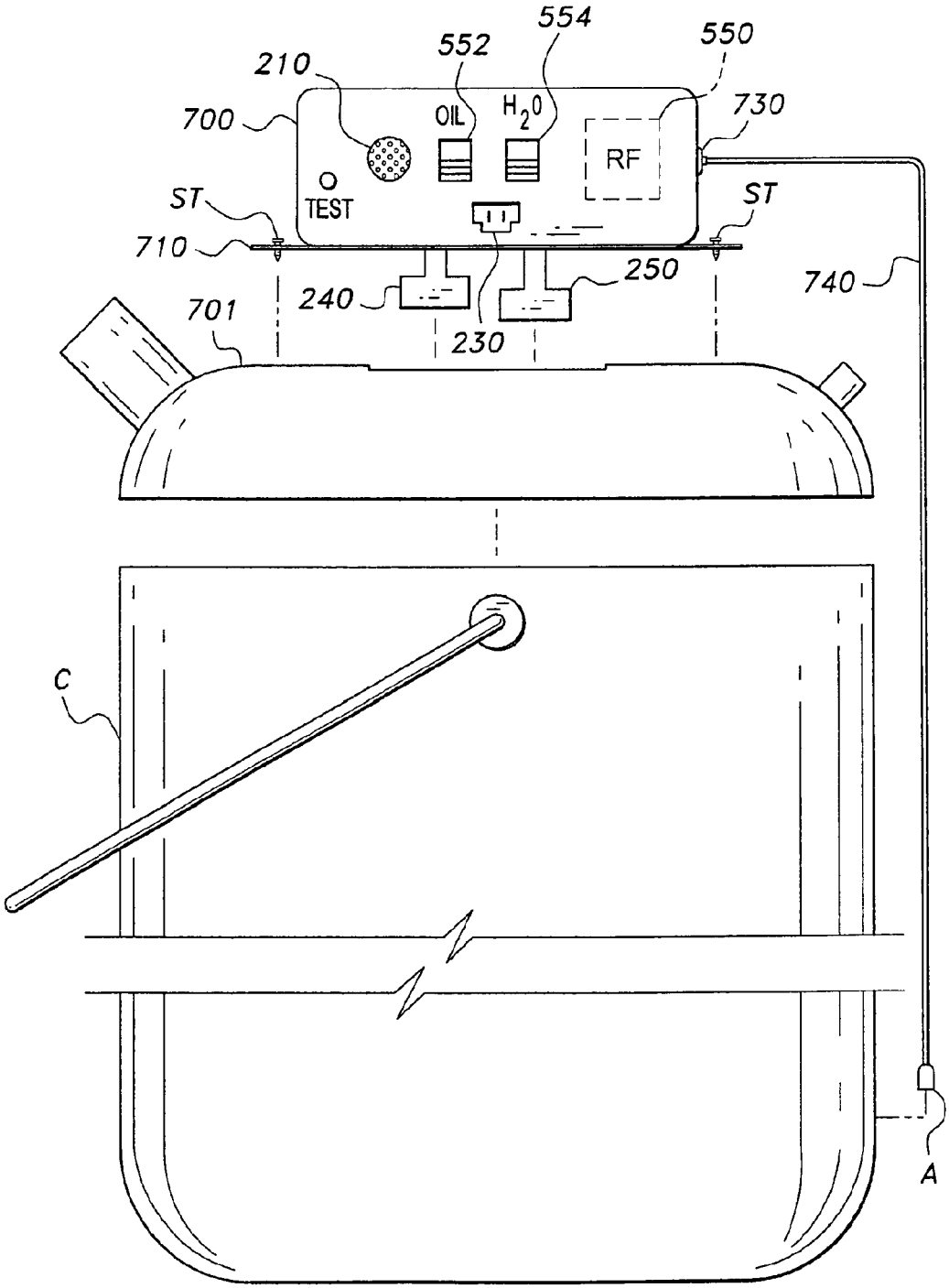
FIG. 7 is an environmental side view of an alternative embodiment of an elevator alert according to the present invention, designed for retrofitting to existing elevator pit cans.

Moreover, as shown in FIG. 7, the elevator alert may be made available in the form of a retrofit kit. The aforementioned alarm components are disposed in a retrofit housing 700 that can be mounted to a preexisting pit can lid 701 that has been prepared with a hole. The retrofit kit comprises a retrofit housing 700, within which are disposed the alarm components, such as loudspeaker 210 capable of 85 dB or greater audible alert output when the alarm is activated, oil cutoff switch 552, water cutoff switch 554, quick connect jack 230 (for remote data/status transmission), RF transceiver 550, and alarm test button TEST. An $H_2O$ wand 740 is connected to the alarm via a connector 730 attached to the housing 700. The end of the $H_2O$ wand 740 is attached to water sensor A, which can be attached to a bottom portion of the bucket to be retrofitted. The float switches 240 and 250 extend from the housing 700 in a manner that does not impede the mechanical motion necessary for float movement when impinged by a rising or falling fluid inside can C. Mounting flanges 710 extend laterally from the bottom portion of the housing 700. Screws ST, preferably self-tapping, are disposed through holes in mounting flanges 710 and can be threaded through an intact portion of retrofitted can lid 701 to secure the elevator alert to the can lid 701, the float switches 240, 250 being disposed through a hole formed in can lid 701 for the purpose.

During operation of the pit can alert 10, users of the elevator, such as passengers or building occupants, would hear the audible alarm and call maintenance to thereby prevent an oil spill.

It is to be understood that the present invention is not limited to the embodiments described above, but encompasses any and all embodiments within the scope of the following claims.

I claim:

1. An elevator alert in fluid communication with an elevator hydraulic fluid mechanism, comprising:

an elevator pit can in fluid communication with the fluid draining from an elevator mechanism;

an audible alarm, the alarm includes a 3-pole test switch disposed on the alarm, the switch having positions for providing an alarm test mode, a normal mode, and a silence mode within electronic circuitry of the alarm, the electronic circuitry within the alarm responsive to the test mode detecting a low voltage condition and alerting a user with a chirping sound when the voltage condition from a power source is low; and a sensor switch responsive to fluid level in the elevator pit can, the switch being electrically connected to the audible alarm and operable to activate the audible alarm when the pit can is nearly full and overflow of fluid into the pit is imminent.

2. The elevator alert, according to claim 1, further comprising:

a first wireless device electrically connected to the sensor switch whereby the first wireless device is adapted to be in electronic interconnectivity to an external control unit having a second wireless device communicating with the first wireless device and having electronic circuitry for automatically responding to an alarm condition communicated by the first wireless device to the second wireless device.

3. The elevator alert, according to claim 2, wherein the first wireless device is a transmitter.

4. The elevator alert, according to claim 2, wherein the first wireless device is a transceiver.

5. The elevator alert, according to claim 1, wherein the audible alarm is disposed on the pit can.

6. The elevator alert, according to claim 1, wherein the sensor switch is a first float switch disposed inside the can, the first float switch being set to activate at a first predetermined level of fluid within the can.

7. The elevator alert, according to claim 6, further comprising a second float switch disposed inside the can, the second float switch being set to activate at a second predetermined level of fluid within the can.

8. The elevator alert, according to claim 1, wherein the sensor switch triggers an alarm at a location remote from the can.

9. The elevator alert, according to claim 1, further comprising a water sensor disposed on an external bottom portion of the pit can, the water sensor for detecting flooding conditions on the pit floor and activating said alarm when flooding conditions are detected.

10. The elevator alert, according to claim 1, wherein said alarm comprises a remote alarm, the elevator alert further comprising:

a low voltage data quick connect jack electrically connected to said sensor switch; and a cable connecting the remote alarm to said sensor switch.

11. The elevator alert, according to claim 10, wherein the remote alarm is responsive to the status of the sensor switch and includes an AC mains power cord and electrically connected indicators consisting of:

a power light emitting diode;

a STATUS/OK LED;

an alarm LED;

data connectors;

test switches.

12. The elevator alert, according to claim 10, wherein the remote alarm comprises at least one power relay, the power relay being configured for deactivating at least one elevator car when an alarm event occurs.

13. The elevator alert, according to claim 10, wherein the remote alarm accepts signals from a plurality of said pit cans.

14. The elevator alert, according to claim 10, further comprising a water sensor attached to said pit can, said remote alarm accepting signals from the water sensor.

15. The elevator alert, according to claim 1, wherein the pit can is formed from a material at least partially translucent for facilitating easy visible inspection of fluid levels therein.

* * * * *